United States Patent [19]

Ishihara et al.

[11] Patent Number: 4,654,478

[45] Date of Patent: Mar. 31, 1987

[54] ELECTRICAL INSULATOR INCLUDING METAL SLEEVE COMPRESSED ONTO A FIBER REINFORCED PLASTIC ROD AND METHOD OF ASSEMBLING THE SAME

[75] Inventors: Takeshi Ishihara, Toyoake; Masaru Kojima, Nagoya, both of Japan

[73] Assignee: NGK Insulators, Ltd., Japan

[21] Appl. No.: 716,094

[22] Filed: Mar. 26, 1985

Related U.S. Application Data

[63] Continuation-in-part of Ser. No. 405,041, Aug. 4, 1982, abandoned, which is a continuation of Ser. No. 154,877, May 30, 1980, abandoned, which is a continuation of Ser. No. 14,162, Feb. 22, 1979, abandoned.

[30] Foreign Application Priority Data

Mar. 2, 1978 [JP] Japan ..... 53-22820

[51] Int. Cl.[4] ..... H01B 17/02; H01B 17/40

[52] U.S. Cl. ..... 174/176; 29/516; 29/631; 403/284; 403/285

[58] Field of Search ..... 174/140 S, 176, 177, 174/178, 179, 186; 29/517, 631, 861, 862, 871; 72/402, 415; 403/274, 284, 285

[56] References Cited

U.S. PATENT DOCUMENTS

| | | | |
|---|---|---|---|
| 2,965,147 | 12/1960 | Hoffman | 29/517 |
| 3,085,316 | 4/1963 | Nelson | 29/517 |
| 3,146,519 | 9/1964 | Redwine | 29/517 |
| 3,152,392 | 10/1964 | Coppack et al. | 29/517 |
| 3,192,622 | 7/1965 | Bannerman | 29/517 |
| 3,511,075 | 5/1970 | Boggio et al. | 29/517 X |
| 3,728,889 | 4/1973 | McIver et al. | 29/517 X |
| 3,736,788 | 6/1973 | Olive-Jones et al. | 72/402 |
| 3,792,603 | 2/1974 | Orain | 29/517 X |
| 3,898,372 | 8/1976 | Kalb | 174/179 |
| 3,994,607 | 11/1976 | Kikuchi et al. | 403/284 |
| 4,092,396 | 5/1978 | McCartney et al. | 29/517 X |
| 4,130,926 | 12/1978 | Willem | 29/517 X |
| 4,242,787 | 1/1981 | Deribas et al. | 29/517 X |

FOREIGN PATENT DOCUMENTS

| | | | |
|---|---|---|---|
| 49-26479 | 7/1974 | Japan | 174/176 |
| 808697 | 2/1959 | United Kingdom | 403/11 |
| 878073 | 9/1961 | United Kingdom | 174/179 |
| 910750 | 11/1962 | United Kingdom | 29/517 |

OTHER PUBLICATIONS

Re, Vittorio, "L'Isoflon, un isolatore in fibre di vetro-resina/PTFE per le reti di transmissione", *Elettrificazione*, No. 6 (Jun.), 1971, pp. 287-295.

*Primary Examiner*—Laramie E. Askin
*Attorney, Agent, or Firm*—Parkhurst & Oliff

[57] ABSTRACT

An improved synthetic resin insulator comprising a reinforced plastic rod and a holding metal fitting having a sleeve is disclosed. In the insulator, the reinforced plastic rod is firmly secured to the sleeve of the holding metal fitting by a divided die means including at least five pieces, wherein the rod is inserted into the sleeve and the outer surface of the rod is substantially uniformly compressed in the centripetal direction by the inner surface of the sleeve by pressure exerted by each of the five divided die means pieces, so that the outer circumference of the rod is uniformly compressed at an optional cross-section thereof. The insulator is free from cracks and whitening in the rod and has an improved durable life.

6 Claims, 15 Drawing Figures

ELECTRICAL INSULATOR INCLUDING METAL SLEEVE COMPRESSED ONTO A FIBER REINFORCED PLASTIC ROD AND METHOD OF ASSEMBLING THE SAME

CROSS REFERENCE TO RELATED APPLICATIONS

This application is a continuation-in-part of application Ser. No. 405,041 filed Aug. 4, 1982 (now abandoned), which in turn is a continuation of application Ser. No. 154,877 filed May 30, 1980 (now abandoned), which in turn is a continuation of application Ser. No. 014,162 filed Feb. 22, 1979 (now abandoned). In addition, this application is related to application Ser. No. 319,087 filed Nov. 6, 1981 (now abandoned), which is a division of application Ser. No. 154,877 filed May 30, 1980 (now abandoned), which in turn is a continuation of application Ser. No. 014,162 filed Feb. 22, 1979 (now abandoned).

BACKGROUND OF THE INVENTION

1. Field of the Invention

The present invention relates to a synthetic resin insulator comprising a rod or pipe made of reinforced plastic (hereinafter referred to as a reinforced plastic rod) and a holding metal fitting to which the rod is secured, and a method of assembling the insulator.

2. Description of the Prior Art

A reinforced plastic rod produced by impregnating fiber bundles arranged in the axial direction or knitted fiber bundles with a synthetic resin and bonding the impregnated fiber bundles through the resin can resist a very high tensile stress and has a very high ratio of strength to weight. However, it is very difficult to secure such reinforced plastic rod to a holding metal fitting without the formation of cracks in the rod and deterioration thereof; therefore, the rod cannot develop fully satisfactory function as a tension insulator under high tension. In order to obviate this drawback, various structures for holding a reinforced plastic rod by a holding metal fitting have been proposed, and a typical holding structure is disclosed in British Pat. No. 816,926 (U.S. Pat. No. 3,152,392). However, the holding structure disclosed in that patent specification still has such drawbacks that the reinforced plastic rod cannot be secured uniformly to the holding metal fitting, and the rod cracks and is whitened and damaged. The present invention aims to obviate these drawbacks.

SUMMARY OF THE INVENTION

A feature of the present invention is a provision of a synthetic resin insulator comprising a reinforced plastic rod and a holding metal fitting wholly or partly composed of a sleeve, said reinforced plastic rod being firmly secured to the sleeve by inserting the rod into the sleeve and compressing the outer surface of the rod in the centripetal direction by the inner surface of the sleeve so that the outer circumference of the rod is uniformly compressed at an optional cross-section thereof.

Another feature of the present invention is the provision of a method of assembling a synthetic resin insulator, wherein a fiber reinforced plastic rod is inserted into a sleeve, which constitutes the whole or a part of a holding metal fitting, and the sleeve is compressed to secure frictionally the fiber reinforced plastic rod in the sleeve of the holding metal fitting, wherein the method comprises inserting a fiber reinforced plastic rod having a substantially smooth cylindrical outer surface into a sleeve having a substantially smooth cylindrical inner surface, compressing the sleeve from at least five independent centripetal directions in substantially the same amount by means of a divided die, which has a pressing surface having a curvature extending substantially along the outer peripheral surface of the sleeve and moves in the centripetal direction, to reduce and deform uniformly and plastically the inner diameter of the sleeve only in the centripetal direction at the cross-section of the sleeve, which cross-section intersects perpendicularly the center axis of the sleeve, and at the same time to reduce and deform uniformly the outer diameter of the fiber reinforced plastic rod within its elasticity only in the centripetal direction, resulting in a uniform frictional force between the inner circumference of the sleeve and the outer circumference of the fiber reinforced plastic rod and a substantially smooth cylindrical interface between the plastically deformed sleeve and the elastically deformed reinforced plastic rod, wherein the difference between the maximum value and the minimum value of the compressed amount of the fiber reinforced plastic rod is less than 1.25%, and preferably not more than 0.5%.

DETAILED DESCRIPTION OF THE INVENTION

Figure 1:
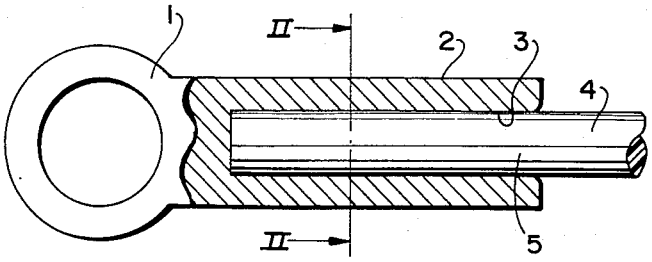
Fig. 1 PRIOR ART
FIG. 1 is a front view of a conventional insulator partly in section, showing that portion of a reinforced plastic rod which is held by a holding metal fitting.
Figure 2:
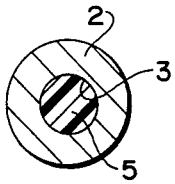
Fig. 2 PRIOR ART
FIG. 2 is a cross-sectional view of FIG. 1 taken on the line II—II in the arrow direction.
Figure 3:
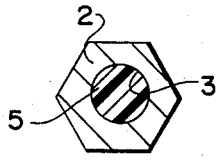
Fig. 3 PRIOR ART
FIG. 3 is an illustrative view of the holding portion in the insulator shown in FIG. 1 under compression.
Figure 4:
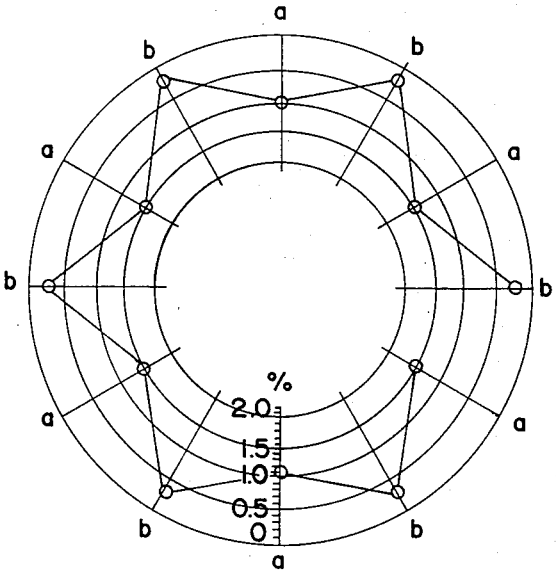
Fig. 4 PRIOR ART
FIG. 4 is a diagrammatic view illustrating the distribution of the compressed amount in percentage in the periphery of the reinforced plastic rod shown in FIG. 1.

For an easy understanding of the structure for holding a reinforced plastic rod by a holding metal fitting in the synthetic resin insulator according to the present invention, an explanation will be made with respect to the holding structure in the synthetic resin insulator disclosed in the above described British Pat. No. 816,926 (U.S. Pat. No. 3,152,392) referring to FIGS. 1–6. In this holding structure, as illustrated in FIGS. 1 and 2, a portion 5 of a reinforced plastic rod 4 to be held is inserted into the bore 3 of a sleeve 2, which constitutes the whole or a part of a holding metal fitting 1, and the outer circumference of the sleeve 2 is compressed from opposite directions by means of a two-piece polygonal die so that the cross-section of the compressed sleeve 2 is permanently deformed into a polygonal shape, such as hexagonal shape shown in FIG. 3, to cause a frictional force between the sleeve and the reinforced plastic rod, whereby the reinforced plastic rod 4 is secured to the holding metal fitting 1. This holding structure is simpler in the shape of the portion of a reinforced plastic rod to be held, in the structure of a holding metal fitting and in the apparatus to be used for securing the rod to the sleeve, and is smaller in the weight of the holding metal fitting and is more useful than a previously known holding structure in the insulator disclosed in, for example, Japanese Utility Model Application Publication No. 26,479/74, which comprises an insulating rod having a tapered portion at the end, a tapered metal fitting which fits to the tapered portion of the rod, a member having a bore for holding the rod, a metal fitting for pressing the tapered metal fitting, and a fastening metal fitting which is threadedly engaged with a threaded portion formed in the interior of the above described bore, said pressing tapered metal fitting being slidably made into contact with the above described tapered metal fitting by means of the fastening metal fitting. However, the holding structure disclosed in the above described British patent still has the following drawbacks. Since the reinforced plastic rod is secured to a sleeve by compressing the sleeve into a polygonal shape, such as hexagonal or the like, there is a difference in the compressed amount of the reinforced plastic rod between a portion a corresponding to the face of the polygonally-shaped sleeve and a portion b corresponding to the corner of the sleeve as illustrated in FIG. 4. That is, the compressed amount of the rod in the portion a corresponding to the face of the sleeve is as large as 1.5% and that in the portion b corresponding to the corner of the sleeve is as small as 0.25%. Thus, a significant difference of 1.25% exists between these compressed amounts in the fiber reinforced plastic rod. The term "compressed amount in percentage of a fiber reinforced plastic rod" used in the context means a value calculated by the following equation:

$$A = \frac{(r_0 - r_1)}{r_0} \times 100\ (\%)$$

where

A: compressed amount in percentage of a fiber reinforced plastic rod in its cross-section which intersects perpendicularly its center axis.

$r_0$: radius of the rod before the rod is held in and compressed by a sleeve.

$r_1$: radius of the rod after the rod is compressed by the sleeve.

That is, the "compressed amount in percentage of a fiber reinforced plastic rod" is a reduced amount in percentage of the radius of the rod based on the original radius of the rod before the compression.

Figure 5:
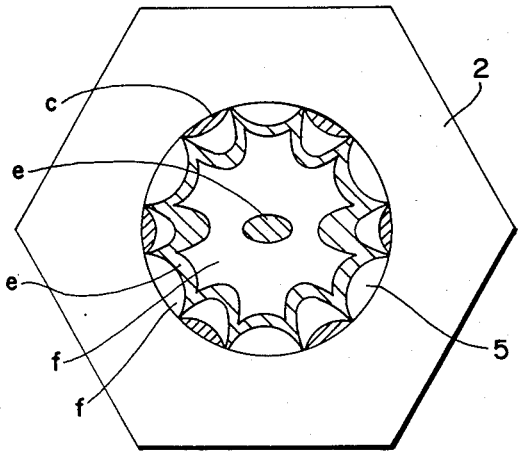
Fig. 5 PRIOR ART
FIG. 5 is a cross-sectional view of the holding portion shown in FIG. 1 after compression, and illustrates a distribution of shearing stress caused in the reinforced plastic rod.
Figure 6:
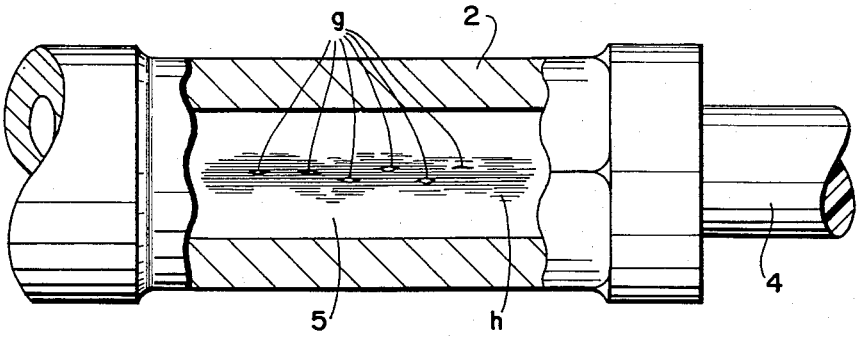
Fig. 6 PRIOR ART
FIG. 6 is a front view, partly in section, of the sleeve of the holding metal fitting shown in FIG. 1 at the holding portion after compression.

Due to the difference between the above described compressed amounts, a tensile stress is caused in the reinforced plastic rod in its circumferential direction at the portion b corresponding to the corner of the sleeve and a shearing stress results in the interior of the reinforced plastic rod. The shearing stress distributes in the form of a petal as illustrated in FIG. 5 in the cross-section of the reinforced plastic rod. In FIG. 5, the reference c represents a portion at which a tensile stress is developed, the reference e represents a high shearing stressed portion and the reference f represents a low shearing stressed portion. The reinforced plastic rod can resist a very high tensile stress in its axial direction, but is poor in its resistance against tensile stress and shearing stress between fibers because fine cracks g are formed by the tensile stress on the surface of the held portion 5 of the reinforced plastic rod by the holding metal fitting at the portion corresponding to the corner of the sleeve 2, and further fibers are separated from synthetic resin, from the surface of the rod to the deeper portion, and the rod is whitened, as shown by the letter h, in the portion having a high shearing stress as illustrated in FIG. 6.

Further, a frictional force generated in the held portion 5 of the reinforced plastic rod by the holding metal fitting is high at the portion corresponding to the face of the sleeve and is weak at the portion corresponding to the corner thereof, and hence the frictional force is not uniform on a circumference at a cross-section of the reinforced plastic rod. That is, since the total surface area of the held portion of the reinforced plastic rod by the holding metal fitting does not contribute effectively to the frictional force, stress is concentrated to a portion having a high frictional force on the surface of a reinforced plastic rod under a tensile load, and the reinforced plastic rod is broken under a tensile load lower than the tensile load in an ideal case, which is free from the above described cracks, whitening and stress concentration.

The present invention aims to obviate the above described drawbacks, to improve the reliability of the portion for holding a reinforced plastic rod by a holding metal fitting, and to provide a synthetic resin insulator comprising a reinforced plastic rod and a holding metal fitting, said plastic rod being held by the metal fitting in a strength higher than the strength in a conventional synthetic resin insulator.

The present invention provides a synthetic resin insulator comprising a reinforced plastic rod and holding metal fitting wholly or partly composed of a sleeve, said reinforced plastic rod being firmly secured to the sleeve by inserting the rod into the sleeve and compressing the sleeve to secure frictionally the fiber reinforced plastic rod in the sleeve of the holding metal fitting, wherein the fiber reinforced plastic rod has a substantially smooth cylindrical outer surface and is inserted into the sleeve which has a substantially smooth cylindrical inner surface, the sleeve is compressed from at least five independent centripetal directions in substantially the same amount by means of a divided die, which has a pressing surface having a curvature extending substantially along the outer peripheral surface of the sleeve and moves in the centripetal direction, to reduce and deform uniformly and plastically the inner diameter of the sleeve only in the centripetal direction at the cross-section of the sleeve, which cross-section intersects perpendicularly the center axis of the sleeve, and at the same time to reduce and deform uniformly the outer diameter of the fiber reinforced plastic rod within its elasticity only in the centripetal direction, resulting in a uniform frictional force between the inner circumference of the sleeve and the outer circumference of the fiber reinforced plastic rod and a substantially smooth cylindrical interface between the plastically deformed sleeve and the elastically deformed reinforced plastic rod.

In a synthetic resin insulator according to the present invention, there is a difference of less than 1.25% between the maximum value and the minimum value of the compressed amount of the reinforced plastic rod on its outer circumference at an optional cross-section thereof. More particularly, the difference in the compressed amount is preferably not more than 0.5%. Therefore, shearing and tensile stresses are not generated to crack and whiten the rod. Further, frictional forces resulting between the sleeve and the reinforced plastic rod are equal on the outer circumference of the rod at an optional cross-section thereof, and stress concentration under a tensile load does not occur. Therefore, the reinforced plastic rod can be held by the holding metal fitting in a strength higher than the strength in the conventional holding structures.

The present invention will be explained in more detail by the following examples referring to FIGS. 7–14. Among the references in these figures, the same references as those shown in FIGS. 1–6 represent the same portion as or corresponding portion to those shown in FIGS. 1–6.

Figure 7:
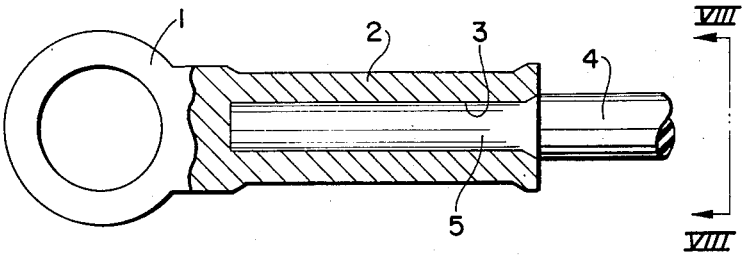
FIG. 7 is a front view of a synthetic resin insulator according to the present invention, partly in section, showing that portion of a reinforced plastic rod which is held by a holding metal fitting.
Figure 8:
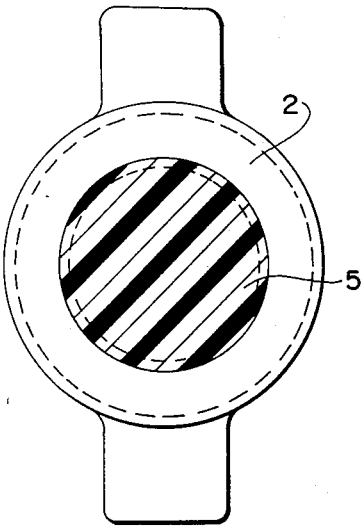
FIG. 8 is a cross-sectional view of FIG. 7 taken on the line VIII≦VIII in the arrow direction.

The synthetic resin insulator of the present invention is characterized in that, as illustrated in FIG. 7, the insulator comprises a reinforced plastic rod 4, which is produced by impregnating bundles of fibers, such as glass and the like, arranged in their longitudinal direction or knitted fiber bundles with a synthetic resin, such as epoxy resin, polyester resin or the like, and bonding the impregnated fiber bundles through the resin, and a holding metal fitting 1 wholly or partly composed of a sleeve. That portion 5 of the reinforced plastic rod 4 which will be held by the metal fitting 1 is firmly secured to the sleeve by inserting the portion 5 of the rod 4 into the bore 3 of the sleeve 2 and compressing uniformly the whole circumference of the bore 3 of the sleeve from the outer surface of the sleeve by means of a liquid under high pressure or other means to compress uniformly the portion 5 of the reinforced plastic rod 4 in the centripetal direction by the sleeve 2.

Figure 9:
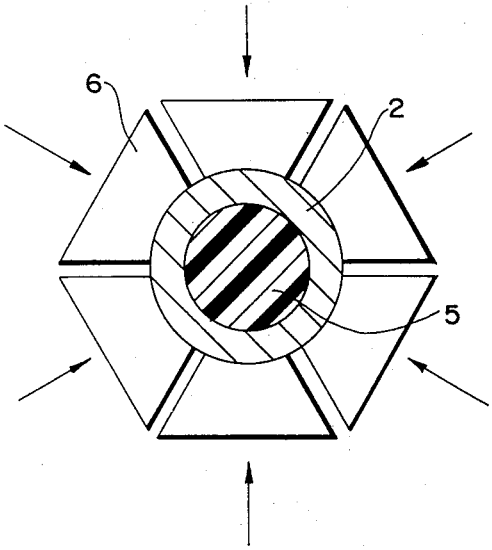
FIG. 9 is a diagrammatic view illustrating one embodiment of a method according to the present invention, which uses a divided die.

In the present invention, the reinforced plastic rod 4 is held by the holding metal fitting 1 in the following manners. That is, the inner circumference of the sleeve 2 is uniformly reduced to reduce uniformly the outer circumference of the portion 5 of the rod 4 at an optional cross-section of the rod, as shown by dotted lines in FIG. 8, whereby the portion 5 of the rod 4 is secured to the sleeve 2. The reinforced plastic rod 4 can be secured to the sleeve 2 by a method other than the use of a liquid under high pressure. For example, the outer surface of the sleeve 2 is compressed by an equal amount in the centripetal direction by means of a divided die 6, which can be separated into at least 3 segments, as illustrated in FIG. 9, but preferably, at least 5 segments, to secure the rod 4 to the sleeve 2. In this case, a major part of the outer surface of the sleeve 2 is compressed by substantially the same amount in the centripetal direction as shown by a dotted line in FIG. 10 to reduce substantially uniformly the inner circumference 3 of the sleeve 2.

Figure 10:
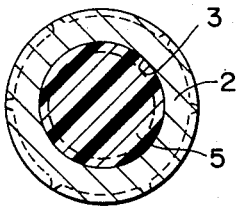
FIG. 10 is a cross-sectional view of the holding portion of the insulator shown in FIG. 7 after compression thereof.

In this case, since the use of a divided die causes a difference between the pressure at the pressing surface of the die segment and that at the gap between each die segment, it is common to consider that a reinforced plastic rod would not be uniformly compressed, but the inventors have found out that, since sleeves for insulators have a sufficiently large thickness, the use of a divided die, whose total pressing surface opposed to a sleeve has a length of not less than 50% of the length of the outer circumference of the sleeve in the circumferential direction thereof, can compress uniformly a reinforced plastic rod through the sleeve. Particularly, when the total pressing surface has a length of not less than 70% of the length of the outer circumference of the sleeve in the circumferential direction thereof, a reinforced plastic rod can be compressed more uniformly. It is preferable that the divided die 6 has a pressing surface having substantially the same curvature with that of the outer surface of a sleeve to be pressed, as illustrated in FIGS. 9 and 10. In this case, when a divided die consisting of at least 8 segments is used, it is not necessary that the curvature of the pressing surface of the die is the same with the curvature of the outer surface of the sleeve, and for example, divided dies having a flat pressing surface or a cylindroid pressing surface can be used.

Figure 11:
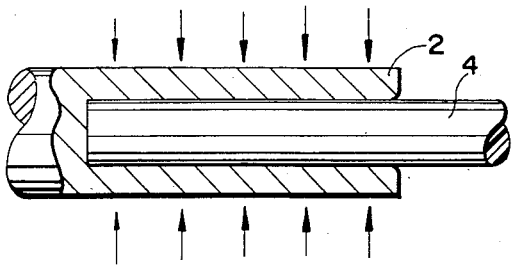
FIG. 11 is a diagrammatic view illustrating one embodiment of a method according to the present invention, which uses a liquid under high pressure.

FIG. 11 illustrates another method for reducing uniformly the inner circumference of a sleeve. In the method illustrated in FIG. 11, the outer surface of a sleeve 2 is compressed in the centripetal direction by means of a liquid under high pressure.

Further, in the present invention, the bore of a sleeve can be reduced in the following manners, which are not shown in the accompanying drawings. A sleeve is pressed from both ends in the axial direction to expand the bore, and the portion of a reinforced plastic rod to be held is inserted into the expanded bore, and then the pressure applied to the sleeve is removed to reduce substantially the bore. Alternatively, a sleeve is heated up to a high temperature, and a previously cooled portion of a reinforced plastic rod to be held is inserted into the bore of the sleeve, and then the sleeve and the portion to be held are made into the same temperature to reduce substantially the bore of the sleeve.

In the above described examples, preferable embodiments of the uniform compression of the reinforced plastic rod have been explained. However, the scope of the present invention is not limited to the above described examples.

Figure 12A:
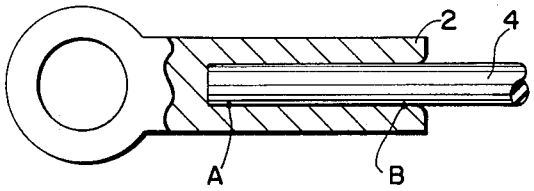
FIG. 12(*s*) is a front view of a synthetic resin insulator according to the present invention, partly in section, and FIG. 12(*b*) is a corresponding diagrammatic view illustrating a longitudinal distribution of the compressed amount of the surface of a reinforced plastic rod at the portion held by a holding metal fitting in the insulator shown in FIG. 12(*a*)
Figure 12B:
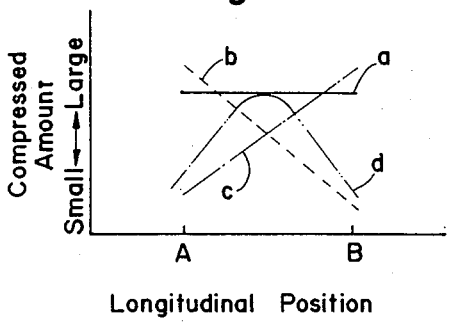
Figure 13:
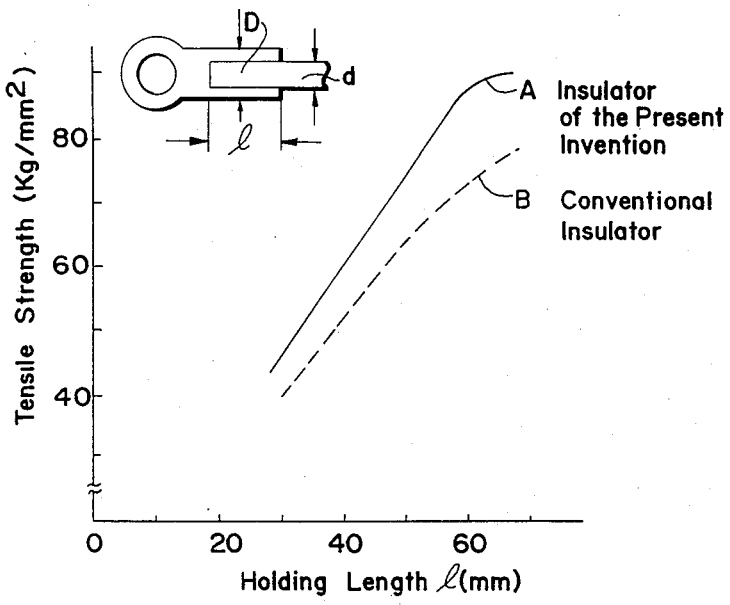
FIG. 13 is a graph illustrating a comparison of tensile strengths at the portion, wherein a reinforced plastic rod is held by a holding metal fitting, between the holding structure according to the present invention and a conventional holding structure.
Figure 14:
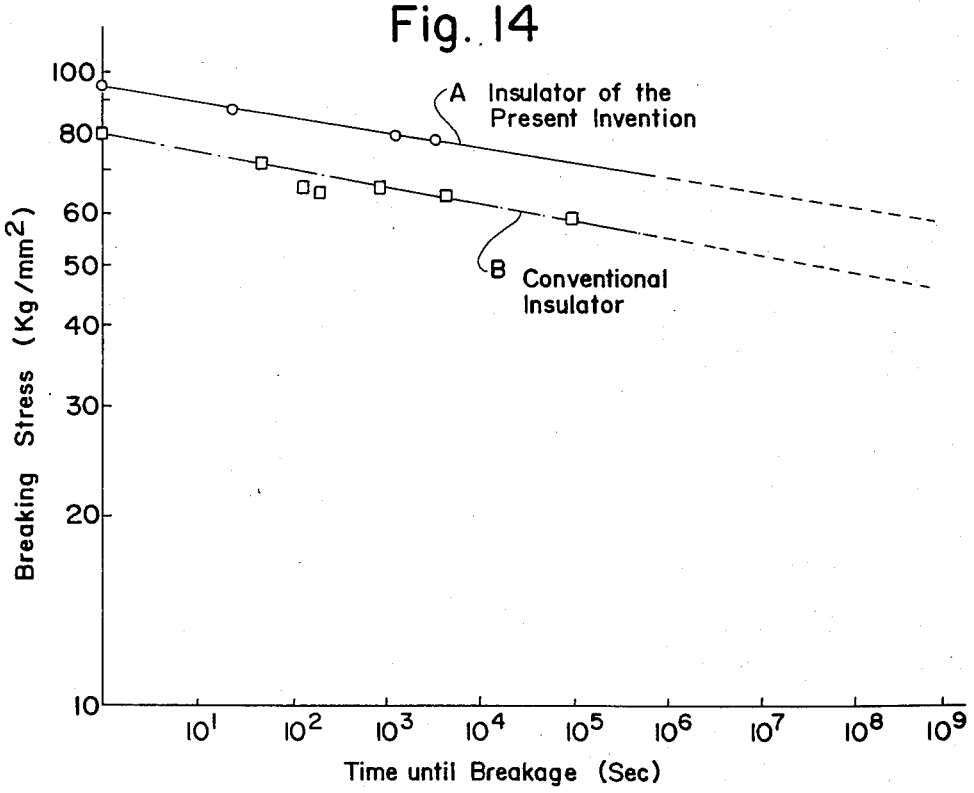
FIG. 14 is a graph illustrating a comparison of durable life of the synthetic resin insulator of the present invention and that of a conventional synthetic resin insulator.

In an insulator according to the present invention, the compressed amount of the surface of a reinforced plastic rod at the portion held by a holding metal fitting distributes in various types along the axial direction of the rod as illustrated in FIG. 12(*b*). Particularly, FIG. 12(*b*) is a diagramatic view of the insulator of the present invention depicted in FIG. 12(*a*). The distribution types are (a) distribution wherein the compressed amount of the rod is uniform along the axial direction of the rod, (b) distribution wherein the compressed amount of the rod decreases towards the opening of the sleeve, (c) distribution wherein the compressed amount of the rod increases towards the opening of the sleeve, (d) distribution wherein the compressed amount of the rod has the maximum value in the middle portion of the sleeve and (e) a combination of the above described distributions. FIG. 13 illustrates a comparison of tensile strengths in the held portion of a reinforced plastic rod by a holding metal fitting between the holding structure in the present invention and the conventional holding structure in the case where a reinforced plastic rod having a diameter of d=19 mm is held in a sleeve having an outer diameter of D=33 mm. In FIG. 13, the solid line shows the tensile strength in the holding structure of the present invention, wherein the entire surface of the sleeve is uniformly compressed, and the dotted line shows the tensile strength in the conventional holding structure, wherein the sleeve is compressed in the form of a polygon. It has been ascertained from FIG. 13 that in any of the above described distributions, a reinforced plastic rod can be held by the holding structure of the present invention in a strength by about 20% higher than the strength in the conventional holding structure under a static tensile load. Further, in the insulator having the holding structure of the present invention, the reinforced plastic rod neither cracks nor whitens, and therefore the excellent mechanical strength inherent to the reinforced plastic rod can be fully developed. Accordingly, as illustrated in FIG. 14, the durable life of a syntheric resin insulator having a holding structure of a reinforced plastic rod and a holding metal fitting according to the present invention is remarkably longer than the durable life of a synthetic resin insulator having a conventional holding structure of the rod and metal fitting.

As described above, the present invention can provide insulators, which comprise a holding metal fitting and a reinforced plastic rod secured to the metal fitting in a high holding strength, without forming cracks nd whitening of the rod and without deteriorating the high resistance of the reinforced plastic rod against tensile stress. Moreover, the insulators having such high strength in the holding structure of the plastic rod by the metal fitting can be widely used as an insulating material for electric lines for tram cars, power transmission lines and the like, as such or after covered with a proper overcoat. Therefore, the present invention is very useful for industry.

What is claimed is:

1. A method of assembling a synthetic resin insulator, wherein a fiber reinforced plastic rod is inserted into a sleeve, which constitutes the whole or a part of a holding metal fitting, and the sleeve is compressed to secure frictionally the fiber reinforced plastic rod in the sleeve of the holding metal fitting, comprising inserting a fiber reinforced plastic rod having a substantially smooth cylindrical outer surface into a sleeve having a substantially smooth cylindrical inner surface, compressing the sleeve from at least five independent centripetal directions in substantially the same amount by means of a divided die, which has a pressing surface having a curvature extending substantially along the outer peripheral surface of the sleeve and moves in the centripetal direction, to reduce and deform uniformly and plastically the inner diameter of the sleeve only in the centripetal direction at the cross-section of the sleeve, which cross-section intersects perpendicularly the center axis of the sleeve and at the same time to reduce and deform uniformly the outer diameter of the fiber reinforced plastic rod within its elasticity only in the centripetal direction, resulting in a uniform frictional force between the inner circumference of the sleeve and the outer circumference of the fiber reinforced plastic rod and a substantially smooth cylindrical interface between the plastically deformed sleeve and the elastically deformed fiber reinforced plastic rod, wherein the difference between the maximum value and the minimum value of compressed amounts of the elastically deformed fiber reinforced plastic rod is less than 1.25%.

2. The method of claim 1, wherein the maximum value of the compressed amount of the elastically deformed fiber reinforced plastic rod corresponds to a face of the plastically deformed sleeve and the minimum value of the compressed amount of the elastically deformed fiber reinforced plastic rod corresponds to a corner of the plastically deformed sleeve.

3. The method of claim 2, wherein the difference between the maximum value and the minimum value of the compressed amounts of the elastically deformed fiber reinforced plastic rod is not greater than 0.5%.

4. The method of claim 1, wherein the difference between the maximum value and the minimum value of the compressed amounts of the elastically deformed fiber reinforced plastic rod is not greater than 0.5%.

5. A synthetic resin insulator comprising a fiber reinforced plastic rod and a holding metal fitting wholly or partly composed of a sleeve, said fiber reinforced plastic rod being firmly secured to the sleeve by the rod having been inserted into the sleeve with an inner surface of the sleeve contacted with an outer surface of the rod, and said sleeve having been compressed and deformed in its centripetal direction about said fiber reinforced plastic rod in substantially the same amount by a die means comprising at least five (5) pieces, said die means having a pressing surface extending along an outer periphery of the sleeve, so that the tensile and shear forces between individual fibers are substantially zero, and the frictional force is uniform between the outer circumference of the fiber reinforced plastic rod and the inner circumference of the sleeve.

6. A synthetic resin insulator comprising a fiber reinforced plastic rod and a holding metal fitting wholly or partly composed of a sleeve, said fiber reinforced plastic rod being firmly secured to the sleeve by the rod having been inserted into the sleeve with an inner surface of the sleeve contacted with an outer surface of the rod, and said sleeve having been compressed and deformed in its centripetal direction about said fiber reinforced plastic rod in substantially the same amount by a die means comprising at least five (5) pieces, said die means having a pressing surface extending along an outer periphery of the sleeve, the fiber reinforced plastic rod having been compressed in substantially the same amount in its centripetal direction by the inner surface of the sleeve such that the difference between the maximum compressed amount and the minimum compressed amount of the rod is less than 1.25% at a cross-section of the rod which intersects perpendicularly a center axis of the rod, resulting in tensile and shear forces between individual fibers being substantially zero, and the frictional force being uniform between the outer circumference of the fiber reinforced plastic rod and the inner circumference of the sleeve.

* * * * *